United States Patent [19]

Deckard

[11] Patent Number: 4,572,433

[45] Date of Patent: Feb. 25, 1986

[54] ELECTROMAGNETIC UNIT FUEL INJECTOR

[75] Inventor: John I. Deckard, Grand Rapids, Mich.

[73] Assignee: General Motors Corporation, Detroit, Mich.

[21] Appl. No.: 642,389

[22] Filed: Aug. 20, 1984

[51] Int. Cl.[4] ..... F02M 47/02; F02M 55/00

[52] U.S. Cl. ..... 239/88; 239/96; 239/125; 239/585

[58] Field of Search ..... 239/88–96, 239/124–126, 585; 123/458, 459

[56] References Cited

U.S. PATENT DOCUMENTS

| | | | |
|---|---|---|---|
| 4,129,255 | 12/1978 | Bader, Jr. et al. | 239/585 X |
| 4,129,256 | 12/1978 | Bader et al. | 239/96 |
| 4,392,612 | 7/1983 | Deckard et al. | 239/88 |
| 4,408,718 | 11/1983 | Wich | 239/88 |
| 4,463,900 | 8/1984 | Wich | 239/88 |
| 4,470,545 | 9/1984 | Deckard et al. | 239/88 |
| 4,482,094 | 11/1984 | Knape . | |
| 4,485,969 | 12/1984 | Deckard et al. . | |
| 4,527,737 | 7/1985 | Deckard | 239/89 |

FOREIGN PATENT DOCUMENTS 3204961 9/1983 Fed. Rep. of Germany .

OTHER PUBLICATIONS

Pending U.S. patent application Ser. No. 595,694, filed Apr. 2, 1984, in the names of John I. Deckard; Richard F. Teerman and Russell H. Bosch.

*Primary Examiner*—Andres Kashnikow
*Assistant Examiner*—Mary Beth O. Jones
*Attorney, Agent, or Firm*—Arthur N. Krein

[57] ABSTRACT

An electromagnetic unit fuel injector for use in a multi-cylinder diesel engine has an externally actuated pump for intensifying the pressure of fuel delivered to a pressure actuated injection valve controlling flow discharge out through a spray outlet and which is normally biased to a closed position by a spring. Pressurized fuel from the pump is also supplied via a throttling orifice to a modulated pressure servo control chamber having a servo piston means operatively associated with the injection valve. A drain passage extends from the servo control chamber with flow therethrough controlled by a solenoid actuated control valve in the form of a poppet valve which is normally biased to a closed position by a valve return spring of predetermined force whereby the control valve is also operative as a pressure relief valve and preferably, a secondary pressure relief valve means is also incorporated into the unit injector so that all of the unit injectors for the engine will operate at a uniform maximum peak pressure.

3 Claims, 9 Drawing Figures

ELECTROMAGNETIC UNIT FUEL INJECTOR

This invention relates to unit fuel injectors of the type used to inject fuel into the cylinders of a diesel engine and, in particular, to an electromagnetic unit fuel injector having a solenoid actuated, control valve therein and a hydraulic servo amplifier to modulate pressure and provide the desired injection characteristics with respect to nozzle valve opening pressure (VOP) and closing pressure (VCP) as a function of engine RPM, the control valve also being operative as a pressure relief valve.

DESCRIPTION OF THE PRIOR ART

Unit fuel injectors, of the so-called jerk type, are commonly used to pressure inject liquid fuel into an associate cylinder of a diesel engine. As is well known, such a unit injector includes a pump in the form of a plunger and bushing which is actuated, for example, by an engine-driven cam whereby to pressurize fuel to a suitable high pressure so as to effect the unseating of a pressure-actuated injection valve in the fuel injection nozzle incorporated into the unit injector.

In one form of such a unit injector, the plunger is provided with helices which cooperate with suitable ports in the bushing whereby to control the pressurization and therefore the injection of fuel during a pump stroke of the plunger.

In another form of such a unit injector, a solenoid valve is incorporated in the unit injector so as to control, for example, the drainage of fuel from the pump chamber of the unit injector. In this latter type injector, fuel injection is controlled by the energization of the solenoid valve, as desired, during a pump stroke of the plunger whereby to terminate drain flow so as to permit the plunger to then intensify the pressure of fuel to effect the unseating of the injection valve of the associated fuel injection nozzle. Exemplary embodiments of such an electromagnetic unit fuel injector are disclosed, for example, in U.S. Pat. Nos. 4,129,255 and 4,129,256, both entitled, "Electromagnetic Unit Fuel Injector", and both issued Dec. 12, 1978, to Ernest Bader, Jr., John I. Deckard, and Dan B. Kuiper, and 4,392,612, same title, issued July 12, 1983, to John I. Deckard and Robert D. Straub.

However all of the known prior art electromagnetic unit injectors are basically of the metering spill type. That is, they are constructed so that they operate to allow free drain fuel flow from the injector system, except during the injection mode wherein the associate system microprocessor controls metering and timing by command to an electromagnetic actuated control valve. With this type electromagnetic unit injector, the rate-of-injection developed is, in effect, a function of engine cam design and cam velocity (RPM), since the pump plunger of the unit injector is suitably driven off the cam. Accordingly, peak pressures attainable within the injection mode time constant are limited.

It is also known that the character of injection termination can be a prime factor in limiting hydrocarbon emissions from diesel engines. In most conventional injectors, fuel injection is terminated by dumping the nozzle system pressure below the force-balance equilibrium of the nozzle valve spring vs. the system pressure and effective nozzle valve journal area. The injection decay time constant for most mechanical and electromagnetic unit injectors varies from 0.5 to 1.0 milliseconds.

An improvement over such prior art injectors has been disclosed in the above-identified U.S. Pat. Nos. 4,129,255 and 4,129,256 which show differing examples of electromagnetic unit injectors having a solenoid actuated control valve controlling spill flow from a hydraulic servo amplifier chamber associated with a fuel injection valve whereby the opening and closing pressure of the injection valve can be regulated as a function of engine speed. However in this latter type unit fuel injectors, fuel injection pressures may exceed a desired peak pressure for the maximum rated engine RPM in a particular engine application.

It will be appreciated by those skilled in the art that, for a particular multi-cylinder engine application, it is desirable to have all of the electromagnetic unit fuel injectors operating at a uniform preselected maximum peak pressure. However since in these spill type unit fuel injectors, the pump capacity is designed so as to exceed that quantity to be injected, it should be now apparent that variations in the diametrical plunger to cylinder wall clearances among the unit fuel injectors will result in corresponding variations of the peak pressures obtained in these unit injectors.

SUMMARY OF THE INVENTION

The present invention relates to an electromagnetic unit fuel injector having a hydraulic servo amplifier chamber therein which is used to modulate pressure whereby to provide objective injection characteristics with respect to nozzle valve opening pressure (VOP) and closing pressure (VCP) as a function of engine RPM and, having an accumulator/manifold system that is operative so as to provide a pressure reservoir availability prior to the coil of the associate solenoid of the unit being energized to effect movement of the solenoid actuated control valve used to control drain flow during a pump stroke of an associate plunger of the unit, the control valve being in the form of a poppet valve whereby it can also be operative as a pressure relief valve to limit peak pressure in the injector.

It is therefore a primary object of this invention to provide an improved electromagnetic unit fuel injector that contains a solenoid-actuated, poppet type control valve, with a hydraulic servo amplifier chamber associated therewith so as to regulate the opening and closing pressure of an associate injection nozzle valve as a function of engine speed, the control valve also serving as a pressure relief valve to effect drainage of fuel at a predetermined high peak pressure.

Still another object of the invention is to provide an improved electromagnetic unit fuel injector having a solenoid-actuated, poppet type control valve therein which is used to control the pressure in a servo chamber associated with the injector valve to regulate opening and closing movement of this injector valve during a pump stroke of the plunger of the pump portion of the unit injector and to serve as a pressure relief valve and also having a second pressure relief valve incorporated therein to effect drainage of fuel whereby to limit peak pressure during operation of the unit injector.

For a better understanding of the invention, as well as other objects and further features thereof, reference is made to the following detailed description of the invention to be read in connection with the accompanying drawings.

DESCRIPTION OF THE PREFERRED EMBODIMENTS

Figure 1:
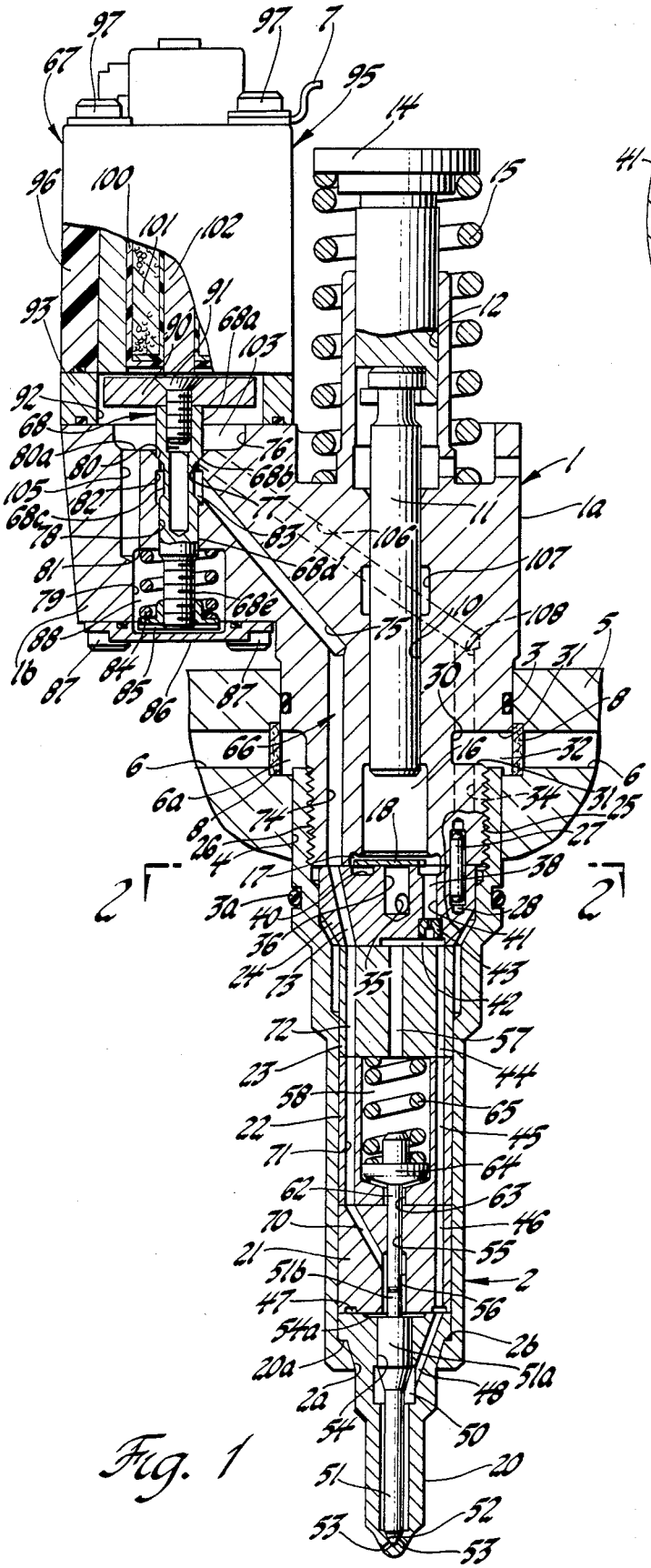
FIG. 1 is a longitudinal sectional view of an electromagnetic unit fuel injector in accordance with a first embodiment of the invention with elements of the injector being shown so that the plunger of the pump thereof is positioned at the top of a pump stroke and with the electromagnetic valve means thereof deenergized.

Referring first to FIG. 1, there is shown an electromagnetic unit fuel injector constructed in accordance with a first embodiment of the invention, that is, in effect, a unit fuel injector-pump assembly with an electromagnetic actuated, poppet type control valve incorporated therein to control fuel discharge from the injector portion of this assembly in a manner to be described in detail hereinafter and which control valve is also operative as a pressure relief valve.

In the construction illustrated, the electromagnetic unit fuel injector has an injector housing that includes an injector body 1 and a nut 2 that is threaded to the lower end of the body 1 to form an extension thereof. In the embodiment shown, both the body 1 and nut 2 are each formed of stepped external configuration and with suitable annular grooves to receive O-ring seals 3 and 3*a* whereby the assembly thereof is adapted to be mounted in a suitable injector socket 4 provided for this purpose in the cylinder head 5 of an internal combustion engine, the arrangement being such that fuel can be supplied to and drained from the electromagnetic fuel injector via one or more internal fuel rails or galleries, such as the common through supply/drain passage 6 which includes an annular cavity 6*a* with a filter 8 therein encircling the unit injector that is suitably provided for this purpose in the cylinder head in a manner known in the art.

In the construction shown, the injector body 1 includes a pump body 1*a* portion and a side body 1*b* portion. As best seen in FIG. 1, the pump body portion 1*a* is provided with a stepped bore therethrough defining a cylindrical intermediate lower wall or bushing 10 to slidably receive a pump plunger 11 and an upper wall 12 of a larger internal diameter to slidably receive a plunger actuator follower 14. The follower 14 extends out one end of the pump body 1*a* whereby it and the plunger 11 connected thereto are adapted to be reciprocated by an engine driven element, and by a plunger return spring 15 in a conventional manner. A stop clip 7 fixed to a solenoid assembly, to be described hereinafter, is positioned so as to limit upward travel of the follower 14.

The pump plunger 11 forms with the bushing 10 a pump chamber 16 at the lower end of the bushing which opens into an annular recess or valve chamber 17 of a suitable internal diameter so as to loosely receive a check valve 18 to be described in detail hereinafter.

As shown, the nut 2 has an opening 2*a* at its lower end through which extends the lower end of a combined injector or spray tip valve body 20, hereinafter referred to as the spray tip, of a conventional fuel injection nozzle assembly. As is conventional, the spray tip 20 is enlarged at its upper end to provide a shoulder 20*a* which seats on an internal shoulder 2*b* provided by the stepped through bore in nut 2.

Between the upper end of the spray tip 20 and the lower end of the pump body 1*a* there is positioned, in sequence starting from the spray tip 20, a servo chamber cage 21, a valve spring cage 22 which also serves as an accumulation chamber, a director cage 23 and a check valve cage 24.

Nut 2, as shown in FIG. 1 is provided with internal threads 25 for mating engagement with the external threads 26 at the lower end of the pump body 1*a*. The threaded connection of the nut 2 to the pump body 1*a* holds the spray tip 20, servo chamber cage 21, valve spring cage 22, director cage 23 and the check valve cage 24 clamped and stacked end-to-end between the upper face of the spray tip and the bottom face of the pump body 1*a*. All of these above-described elements have lapped mating surfaces whereby they are held in pressure sealed relationship to each other. In addition, a predetermined angular orientation of these above-described elements with respect to the pump body 1*a* and to each other is maintained by means of dowel or alignment pins 27 positioned in suitable blind bores 28 provided for this purpose in these elements in a conventional manner as well known in the art, only one such dowel pin being shown in FIG. 1.

As best seen in FIG. 1, the pump body 1*a* is provided with a chordal flat recessed slot 30 bounded by opposed surfaces 31 at the upper end of its lower reduced threaded 26 portion in a location so as to define a supply/drain cavity or chamber 32 that is in flow communication with the supply/drain passage 6 when this unit injector is mounted in the cylinder head 5 and axially retained therein by a suitable hold down clamp, not shown, in a conventional manner.

Figure 2:
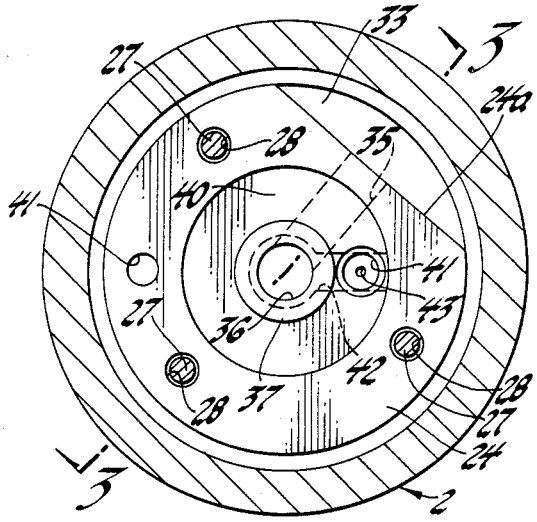
FIG. 2 is an enlarged sectional view of the unit fuel injector of FIG. 1 taken along line 2—2 of FIG. 1.

In addition, as best seen in FIG. 2, the check valve cage 24 is provided on one side thereof with a chordal flat 24*a* so as to define, with a portion of the upper internal wall surface of the nut 2, a fuel chamber 33 located so as to be in flow communication with the supply/drain cavity 32 by means of a vertical supply passage 34 formed in the lower reduced diameter end of the pump body 1*a*, as shown in FIG. 1.

The pump chamber 16 is adapted to be supplied with fuel from the fuel chamber 33 via a supply passage 35 in the check valve cage 24 (FIGS. 2 and 3) that extends radially from the chordal flat 24*a* to intersect a central vertical supply passage 36 opening at its upper end into the valve chamber 17 (FIG. 1). The upper end of the supply passage 36 is encircled by an annular flat valve seat 37 against which the check valve 18 can seat whereby this valve element can operate as a one-way check valve. Thus fuel can flow via the above-described valve controlled supply passage means during a suction stroke of the plunger 11, but no return flow of fuel will occur during a pump stroke of the plunger 11.

Figure 3:
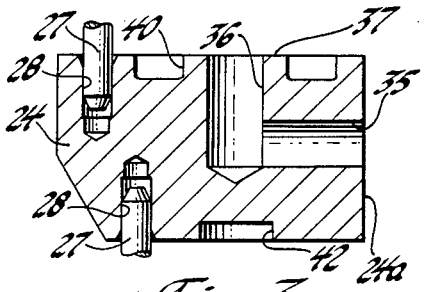
FIG. 3 is an enlarged longitudinal sectional view of the check valve cage, per se, of the unit fuel injector of FIG. 1.

During operation, on a pump stroke of the plunger 11, pressurized fuel is adapted to be discharged from the pump chamber 16 via the valve chamber into the inlet end of a discharge passage means, generally designated 38, to be described next hereinafter. As part of this discharge passage means 38, the check valve cage 24, as shown in FIGS. 1–3, is provided on its upper end with an annular groove 40 encircling the supply passage 36 radially outboard of the valve seat 37 so as to face the valve chamber 17 for flow communication therewith and to thus define the upper end of the discharge passage means 38. The check valve 18, in the embodiment illustrated, is in the form of a fluted disc valve, that is, it is of a scalloped outer peripheral configuration so as to permit flow to and from the pump chamber 16 via the enlarged annular recess defining the valve chamber 17.

In addition, as best seen in FIG. 1, the check valve cage 24 is provided with a vertical stepped bore passage 41 that extends from the bottom of groove 40 so as to open into a key-hole shaped recessed cavity 42 provided in the lower surface of the check valve 24. In the construction illustrated, the passage 41 is preferably provided with a snubber orifice means 43, of predetermined flow area, so as to smooth out possible pressure transients.

The discharge passage means 38 also includes a vertical passage 44 that extends through the director cage 23 and is located so that its upper end, as seen in FIG. 1, is in flow communication with the cavity 42 and its opposite end is aligned with a longitudinal passage 45 through the valve spring cage 22 and a similar passage 46 extending through the servo chamber cage 21. Passage 46, at its lower end opens into an annular groove 47 provided in the lower surface of the servo chamber cage 21 in a location so as to be in flow communication via at least one inclined passage 48 in the spray tip 20 with a central passage 50 encircling a conventional needle type nozzle or injection valve 51 movably positioned in the spray tip. At the lower end of the passage 50 is an outlet for the delivery of fuel with an encircling tapered annular valve seat 52 for the injection valve 51 and, below the valve seat are one or more connecting spray orifices 53. The upper end of the spray tip 20 is provided with a guide bore 54 for guidingly receiving the enlarged diameter stem 51*a* portion of the injection valve 51 and this bore is encircled by a recessed cavity 54*a* which is provided in the upper surface of the spray tip 20, in the construction shown.

Now in accordance with a feature of the invention, the servo chamber cage 21 is provided with an axial stepped through bore of predetermined diameters so as to define an upper piston guide bore 55 and a lower enlarged internal diameter wall defining, with the recessed cavity 54*a* in the construction shown in FIG. 1, a pressure modulating or servo control chamber 56 which is in flow communication at its lower end with the cavity 54*a*.

As show in FIG. 1, the reduced diameter stem 51*b* of the injection valve 51 extends a predetermined distance into the servo control chamber 56 for a purpose to be described hereinafter.

Figure 4:
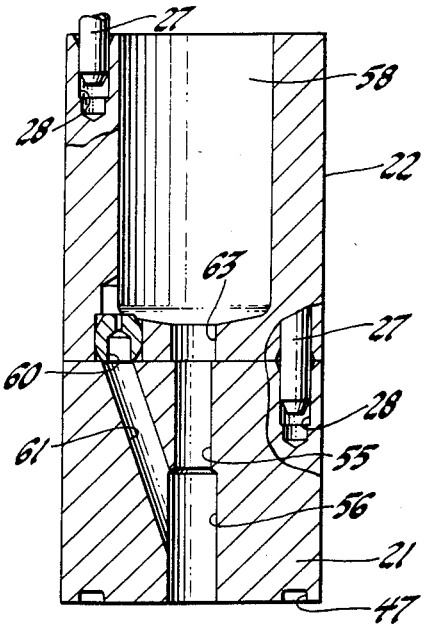
FIG. 4 is an enlarged longitudinal sectional view of the valve spring cage and servo piston cage, per se, of the unit fuel injector of FIG. 1, which has been rotated 90° relative to the view of these elements shown in FIG. 1.

During a pump stroke of the plunger 11, pressurized fuel is supplied to the servo control chamber 56 via an axial passage 57 in the director cage 23 (FIG. 1), which at its upper end is in flow communication with a portion of the cavity 42 and which at its lower end opens into an accumulator/manifold chamber 58 provided in the upper end of the valve spring cage 22, which also serves as a chamber for an injection valve return spring 65, described hereinafter. As best seen in FIG. 4, fuel can then flow from the accumulator/manifold chamber 58 via a throttle orifice passage 60, of predetermined flow area, operatively positioned in the lower end of the valve spring cage 22, and an inclined passage 61 formed in the servo chamber cage 21 so as to open into the servo chamber 56.

A servo piston means 62, of predetermined diameter, is slidably and sealingly guided in the guide bore 55 and this servo piston means is of an axial extent so that its lower end loosely extends into the servo control chamber 56 whereby to abut against the upper free end of the stem 51*b* portion of the injection valve 51. The servo piston means 62 at its upper end loosely extends through a central opening 63 in the valve spring cage 22 into the spring chamber 58 where it abuts against a spring seat 64. Compressed between the spring seat 64 and the lower surface of the director cage 23 is the coiled valve return spring 65 which is operative, via the servo piston means 62, to normally bias the injection valve 51 into abutment against the valve seat 52, the closed position of this injection valve as shown in FIG. 1.

Figure 5:
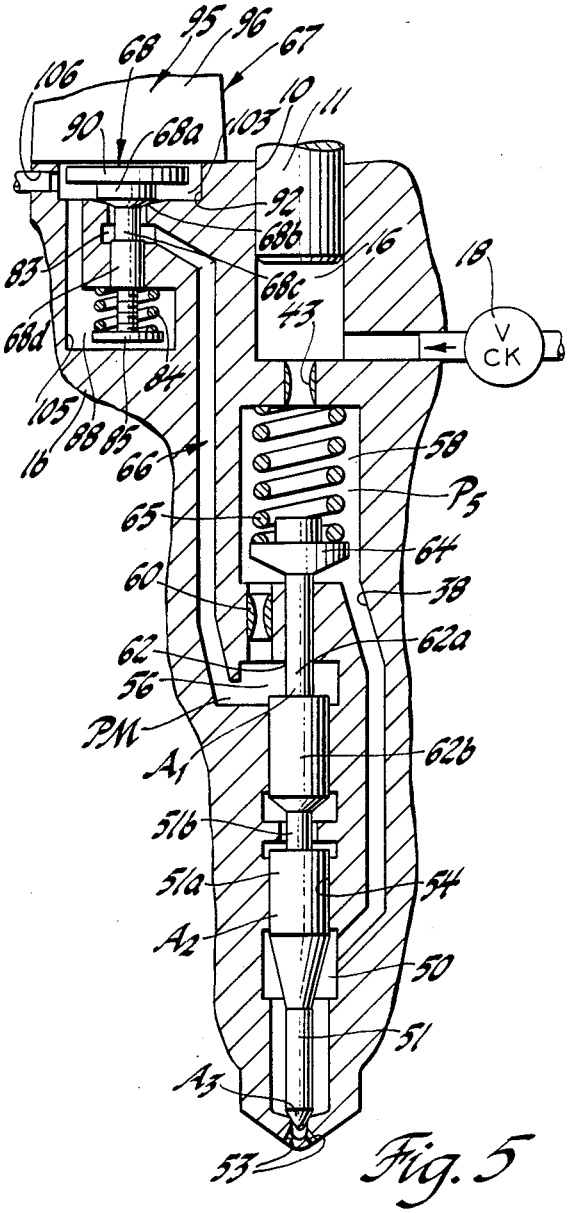
FIG. 5 is a schematic functional illustration of the operating elements of the unit fuel injector of FIG. 1.
Figure 7:
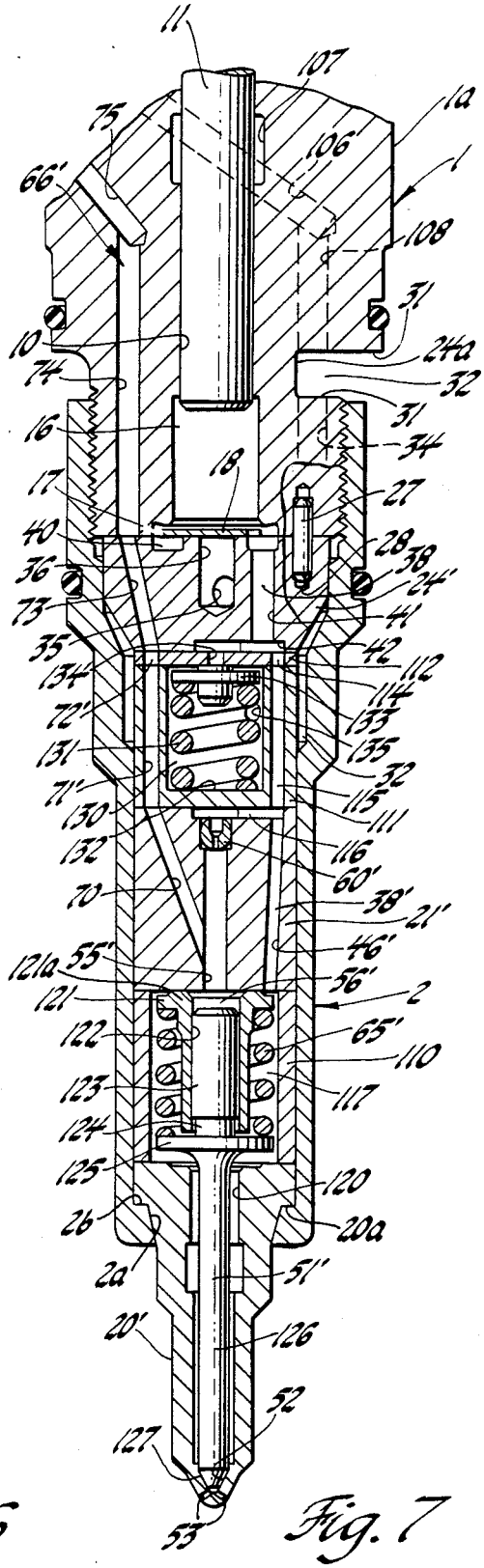
FIG. 7 is a longitudinal sectional view of the lower portion of an alternate embodiment of an electromagnetic unit fuel injector in accordance with the invention.
Figure 8:
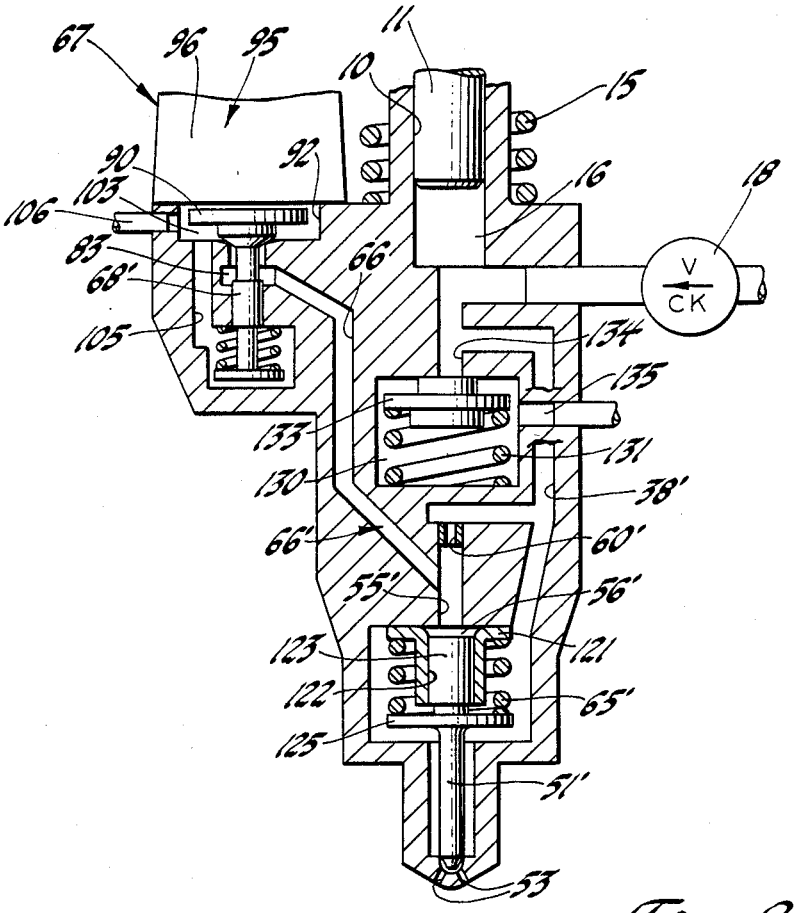
FIG. 8 is a schematic functional illustration of the operating elements of the unit fuel injector embodiment of FIG. 7; and, FIG. 9 is a longitudinal sectional view of the lower portion of a further embodiment of an electromagnetic unit fuel injector similar to that of FIG. 1 but having a pressure relief assembly incorporated therein.

The element 62 is referred to herein as a servo piston means because, as shown in FIG. 5, it can be formed as a separate element and provided with a stem 62*a* portion and a piston 62*b* portion, which may be of the same diameter as the stem 51*a* of the injection valve 51, whereby the pressure of fuel in the servo control chamber 56 will act on the effective area differences of the stem 62*a* and piston 62*b* in an injection valve 51 closing direction. Alternatively, for ease of manufacture and assembly and as shown in the FIG. 1 structrual embodiment, the servo piston means 62 can be made the same diameter as the stem 51*b* portion of the injection valve 51 so as to permit the enlarged diameter stem 51*a* portion of the injection valve 51 to become, in effect, the operative piston portion of the servo piston means 62. Alternatively, as shown in the embodiment of FIGS. 7 and 8, the servo piston means 62' can be formed as an integral part of the injection valve 51' in this alternate unit injector embodiment to be described in detail hereinafter.

During a pump stroke of plunger 11, the actual start and end of injection and also the opening and closing pressures of the injection valve 51 are regulated by the controlled drainage of fuel from the servo chamber 56 by means of a spill or drain passage means, generally designated 66, with flow therethrough controlled by means of a solenoid 67 actuated pilot, poppet type control valve 68, which in accordance with a feature of the invention is also operative as a relief valve.

The lower end of the drain passage means 66 is defined by an inclined passage 70, which as shown in FIG. 1, is provided in the servo chamber cage 21 so as to extend from the servo control chamber 56 upward to communicate with the lower end of a longitudinal passage 71 extending through the valve spring cage 22. Passage 71 in turn communicates at its upper end with the lower end of a similar passage 72 extending through the director cage 23. The upper end of passage 72 is in flow communication with the lower end of an inclined passage 73 located in the check valve cage 24 so that its upper end is in flow communication with the lower end of a vertical passage 74 provided in the pump body 1*a* Passage 74, at its other end, intersects the lower end of an inclined passage 75 which has its upper end located, as described hereinafter in the side body portion 1*b* so that flow therethrough can be controlled by the pilot control valve 68 in a manner to be described.

For this purpose and for another purpose to be described, in the embodiment shown in FIG. 1, the side body 1*b* portion of the pump body 1 is provided with a stepped bore therethrough to define circular internal walls including an upper wall 76, an upper intermediate wall 77, a lower intermediate valve stem guide wall 78 and a lower wall 79. The guide wall 78, as shown, is of smaller internal diameter than that of walls 76, 77 and 79. Walls 76 and 77 are interconnected by a flat shoulder 80*a* which terminates with an inclined wall defining an annular conical valve seat 80 encircling wall 77. Walls 78 and 79 are interconnected by a flat shoulder 81. Also as shown, an annular groove 82 is provided between the upper intermediate wall 77 and the guide wall 78.

Figure 6:
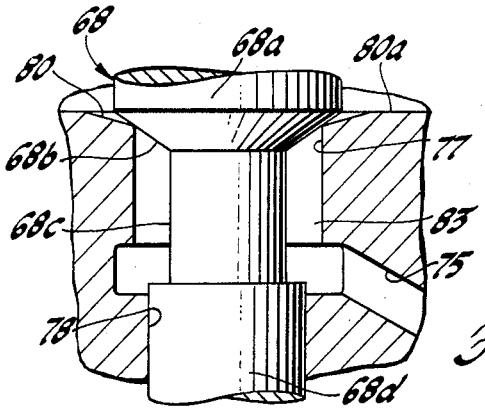
FIG. 6 is an enlarged, somewhat schematic, illustration of the control valve, per se, of the unit fuel injector of FIGS. 1 and 5.

The pilot control valve 68, in accordance with a feature of the invention and as shown in FIGS. 1, 5 and 6, is in form of a poppet valve, so as to include a head 68*a* with a conical valve seat surface 68*b* thereon and a stem depending therefrom which includes a reduced diameter portion 68*c* next adjacent to the head 68*a*, an intermediate stem portion 68*d* of a diameter to be slidably received by the guide wall 78 and a lower reduced diameter externally threaded free end portion 68*e*. The reduced diameter portion 68*e* of the stem defines with the groove 82 an annulus cavity 83 that is in communication with the upper end of the drain passage 75.

The pilot control valve 68 is normally biased in a valve closing direction so as to seat against the valve seat 80 at the edge where this valve seat 80 interconnects with wall 77, the position shown in FIGS. 1, 5 and 6, by means of a valve return spring 84, of a predetermined force, loosely encircled by the bore wall 79. One end of this spring 84 abuts against a tubular spring seat 85 suitably fixed to the threaded stem end 68*e* of the control valve 68 while its opposite end abuts against the flat shoulder 81. A cap 86 is secured, as by screws 87, to the lower surface of the side body 1*b* so as to define with the wall 79 and shoulder 81 a pressure equalizing chamber 88 for a purpose to be described hereinafter.

Normal movement of the pilot control valve 68 in a valve opening direction is directly affected by means of the solenoid assembly 67. Accordingly, as seen in FIG. 1, an armature 90 is fixed to the upper end of the head 68*a* of the pilot control valve 68, as by a screw 91, and the armature 90 is thus located so as to be loosely received in a complementary shaped armature cavity 92 provided in a ring-like solenoid spacer 93 for movement relative to an associate pole piece.

As shown, the solenoid 67 further includes a stator assembly, generally designated 95, having an inverted cup-shaped solenoid case 96, made for example, of a suitable plastic such as glass filled nylon, which is secured as by screws 97 to the upper surface of the side body portion 1*b*, with the solenoid spacer 93 sealingly sandwiched therebetween, in position to encircle the bore wall 76. As shown, one or more of the screws 97 are also used to retain the stop clip 7 against an upper surface of the solenoid case 96. A coil bobbin 100, supporting a wound solenoid coil 101 and a segmented multi-piece pole piece 102 are supported within the solenoid case 96, this stator assembly being similar to that disclosed in the above-identified U.S. Pat. No. 4,392,612.

In the construction illustrated, the lower surface of the pole piece 102 is aligned with the lower surface of the solenoid case 96, as shown in FIG. 1. With this arrangement, the thickness of the solenoid spacer 93 is preselected relative to the height of the armature 90 above the upper surface of the side body portion 1*b*, when control valve 68 is in its closed position, so that a predetermined clearance exists between the upper working surface of the armature and the plane of the upper surface of the solenoid spacer whereby a working air gap will exist between the opposed working faces of the armature and pole piece.

As would be conventional, the solenoid coil 101 is adapted to be connected to a suitable source of electrical power via a fuel injection electronic control circuit,, not shown, whereby the solenoid coil can be energized as a function of the operating conditions of an associated engine in a manner well known in the art.

The stator assembly 95 thus forms, with the armature cavity 92 of the solenoid spacer 93 and the wall 76 and shoulder 80*a* in the side body 1*a*, a spill or drain chamber 103.

Accordingly, when the solenoid coil 101 is energized to effect upward movement of the armature 90 and thus opening movement of the control valve 68 a drain discharge orifice, of predetermined flow area is thus provided as defined by the flow area that exists between the valve seating surface of the control valve and the valve seat 80.

As shown in FIGS. 1 and 5, a passage means 105 is arranged in the side body portion 1*b* so as to interconnect the pressure equalizing chamber 88 with the drain chamber 103 whereby the pressure acting on opposite ends of the pilot control valve 68 will be maintained substantially equal. In addition and as a continuation of the drain passage means 66, the drain chamber 103 is in fluid communication with the supply/drain chamber 32 by an inclined passage 106 that extends downward from the shoulder 80*a*, breaking into the annular cavity 107 encircling the plunger 11 and then interconnecting with the upper end of a vertical passage 108 in the pump body 1*a*, which at its lower end opens into the supply/drain chamber 32 as shown in FIG. 1.

Functional Description

Referring now in particular to FIGS. 1 and 5, during engine operation, fuel from a fuel tank, not shown, is supplied at a predetermined supply pressure by a pump, not shown, to the supply/drain chamber 32 of the subject electromagnetic unit fuel injector through the supply/drain passage 6 and annular cavity 6*a*. Assuming that all of the passages and chambers are full of fuel, then on a suction stroke of plunger 11, fuel can flow via the passage 34, fuel chamber 33 and passages 35, 36 and pass the check valve 18 into the pump chamber 16.

Thereafter, as the plunger 11 is moved downward on a pump stroke, this downward movement of the plunger 11 will cause fuel to be displaced from the pump chamber 16 and will cause the pressure of fuel in this chamber and adjacent passages to increase. This of course will cause immediate seating of the check valve 18 against the valve seat 37 blocking flow back through the passage 36.

Pressurized fuel than flows via the passage 41 and through the snubber orifice into the cavity 42 from where it can flow via passages 44, 45, 46, groove 47 and passage 48 into the passage 50 in the spray tip 20 surrounding the injection valve 51. At the same time fuel can flow from cavity 42, via passage 57 into the accumulator/manifold chamber 58 and then through the throttle orifice passage 60 and passage 61 into the servo control chamber 56. The accumulator/manifold chamber 58 provides a pressure fuel reservoir availability prior to the electronic control circuit injection command. Servo control chamber 56 is also in flow communication with the drain passage means 66, flow through which is controlled by the solenoid actuated, normally closed, poppet type, pilot control valve 68.

Since the injection valve 51 is normally held in its closed position by the force F1 of the valve return spring 65, this valve would normally open when the fuel pressure acting on the differential area on the lower stem end of this valve was such as to overcome the force of the spring 65, as well known in the art.

However, with the arrangement shown, during the initial stage of the pump stroke of plunger 11 and with the control valve 68 in its normally closed position shown in FIGS. 1 and 5, that is, with the solenoid deenergized, the injection valve 51 is maintained seated against the valve seat 52 by the force summation of the valve spring 65 and the pressure of fuel in the servo control chamber 56 acting on the effective area of the servo piston means 62.

Thereafter, during the continued downward stroke of the plunger 11, an electrical (current) pulse of finite characteristic and duration (timed relative, for example, to the top dead center of the associate engine piston with respect to the camshaft and rocker arm linkage) applied to the solenoid coil 101 produces an electromagnetic field attracting the armature 90 to effect its movement upward to the pole piece 102. This upward movement of the armature 90, as coupled to the control valve 68, will effect unseating of the pilot control valve 68 from the valve seat 80, thus allowing controlled fuel flow through the drain passage means 66 from the servo control chamber 56 so as to release the pressure in this servo control chamber at a rate as controlled by respective flow areas of the throttle orifice passage 60 and the orifice passage defined by the head of the control valve 68 and valve seat 80.

It will be appreciated that the respective flow areas of these orifice passages can be preselected, as desired, as a means to control the rate of pressure drop in the pressure modulated servo control chamber 56, to thus control the injection valve 51 lift rate, and, accordingly, the rate of fuel injection from the nozzle.

The pressure drop in the servo control chamber 56 thus reduces the resultant hydrostatic force holding down the injection valve 51, which now lifts, and injection is initiated from the pressure head developed by the continued downward stroke of the plunger 11. As described above, the rate of injection valve 51 lift is controlled, as desired, by the predetermined election of the flow area ratios of the drain discharge valve head/valve seat orifice to the throttle orifice 60.

Ending the current pulse to the solenoid coil 101 causes the electromagnetic field to collapse, allowing the spring 84 to again close the pilot control valve 68 blocking flow through the discharge passage means 66 to thus allow pressure to again increase in the servo control chamber 56. As the pressure in the servo control chamber 56 increases and passes thru the force-balance equilibrium point of the servo mechanism causing the injection valve 51 to close, injection will be terminated almost instantly. This servo mechanism is thus operative so as to eliminate the variable pressure decay rates, offsets and dribbling common with prior known injection systems.

The finite pilot control valve 68 control of this hydrostatic force-balance stem can allow subsequent injections to be programmed and/or merged so as to provide pilot injection, if desired, for effective noise abatement during engine operation.

Now in accordance with a feature of the invention, the pilot control valve 68 is formed as a poppet valve and is arranged so that it can also function as a pressure relief valve. For this purpose and as best seen in FIG. 6, the internal diameter of wall 77 is a preselected amount greater than the internal diameter of the guide wall 78 whereby the pressure (P) of fuel in the annulus cavity 83 will act on the effective differential valve area ($\Delta A$) in a valve opening direction, upward with reference to this Figure.

The force (Fs) of the valve return spring 84 is accordingly preselected so that the control valve 68, even with the solenoid coil 101 deenergized, will open when a predetermined desired peak injection pressure begins to be exceeded. In addition, by the use of this type of unbalanced control valve 68, the effective control valve opening force (F) required to be generated by the solenoid 67 will decrease as the pressure of fuel in the annulus cavity 83 increases.

For example, in a particular electromagnetic unit fuel injector application, this differential valve area $\Delta A$ was preselected to be 0:003 in.$^2$ and, accordingly, the closing force of the valve return spring 84 was preselected to be 54 pounds. In this application, the control valve 68 was then operative to act as a pressure relief valve when the pressure of fuel in the annulus cavity 83 exceeded approximately 18,000 psi.

Since, as described hereinabove, the flow area of the drain orifice, that is, the flow area between the head 68*a* of the control valve 68 and valve seat 80 is preselected relative to the flow area of the throttle orifice 60 whereby to regulate the pressure drop in the servo control chamber 56 when the solenoid is energized, the pressure relief capability may not be adequate in certain electromagnetic unit fuel injector applications.

Accordingly, there is shown in FIG. 7 and schematically in FIG. 8 an alternate embodiment of an electromagnetic unit fuel injector in accordance with the invention, wherein similar parts are designated by similar numerals but with the addition of a prime (′) where appropriate, which includes a secondary pressure relief valve.

As shown in FIG. 7, the nut 2 in this alternate embodiment is used to retain a spray tip 20′, a sleeve 110, a servo chamber cage 21′, a pressure regulator cage 111, an orifice plate 112 and a check valve cage 24′ clamped and stacked end-to-end in a manner similar to that previously described with reference to the unit injector embodiment of FIG. 1.

The check valve cage 24′ in the FIG. 7 embodiment is similar to the corresponding cage 24 described with reference to the FIG. 1 embodiment except that a snubber orifice means is not provided in the passage 41 connecting groove 40 to the recessed cavity 42 at the bottom of this cage in the upper portion of the discharge passage means 38'. As a continuation of this discharge passage means 38', the orifice plate 112 is provided with a passage 114 in flow communication at one end with the cavity 42 and at its other end with a through passage 115 in the pressure regulator cage 111. Passage 115 at its lower end opens into a radial extending recessed cavity 116 which is in flow communication with the upper end of the longitudinal passage 46' in the servo chamber cage 21'. The passage 46' at its lower end is positioned so as to be in flow communication with fuel chamber 117 defined by the interior of sleeve 110.

In the construction shown, the spray tip 20' is provided with an axial stepped passage 120 which is in communication at its upper end with the fuel chamber 117 and which is in communication at its other end with one or more discharge orifices 53 and with a valve seat 52 located in the passage 120 upstream of the discharge orifices 53.

Located within the fuel chamber 117 and laterally spaced from the interior of the sleeve 110 is a flanged, tubular valve guide bushing 121 having a central bore 122 therethrough of predetermined internal diameter for slidably receiving the upper enlarged diameter piston 123 stem end of an injection valve 51' and being provided at its upper end with radial flange **121*a* with an annular seating surface at its upper end for abutment against the lower surface of the servo chamber cage 21'**.

In the embodiment shown in FIG. 7, the injection valve 51' includes the piston 123 stem end, an intermediate reduced diameter stem portion 124 connecting piston 123 to an enlarged radial flange or collar 125 and an elongated stem 126 depending from the collar 125 to terminate at a conical valve tip 127 of a configuration to sealingly engage the valve seat 52.

A coil valve return spring 65', of predetermined spring load or force is positioned in the fuel chamber 117 to loosely encircle the bushing 121 with one end thereof in abutment against the underside of collar **121*a* and its opposite end in abutment against the collar 125. Spring 65' is thus operatively positioned to normally bias the injection valve 51' into seating engagement with the valve seat 52**.

In this FIG. 7 embodiment, the servo chamber cage 21' with an axial stepped passage bore 55' extends downward from the cavity 116 so as to open into bore 122 in the bushing 121 whereby to define therewith a servo control chamber 56' with the flow of fuel thereto controlled by a throttle orifice 60' operatively positioned in the bore passage 55'.

In the alternate unit injector embodiment of FIG. 7, the drain passage means 66 would thus include the inclined drain passage 70 in the servo chamber cage 21', a passage 71' extending through the pressure regulator cage 111 and the passage 72' through orifice plate 112 which in turn connects via passage 73 in the check valve cage 24' to the passage 74 and 75 in the injector body 1 previously described.

Instead of using only the pilot control valve 68 as a pressure relief valve as described with reference to the FIG. 1 embodiment, in this alternate FIG. 7 embodiment, a separate secondary pressure relief valve means is incorporated into the elements contained in nut 2 in a location upstream of the servo chamber cage 21'.

For this purpose, the pressure regulator cage 111 is provided with a cup-shape configuration to define an internal spring chamber 130 to loosely receive a spring 131 of predetermined force. As shown in FIG. 7, one end of the spring 131 abuts against the bottom wall 132 defining the lower end of the spring chamber 130 and at its upper end the spring abuts against a pressure relief valve 133 in the form of a disc valve, to normally bias the disc valve 133 against the lower face of the orifice plate 112 so as to block flow through the central passage 134 in the orifice plate 112 which is in flow communication with the cavity 42 in the check valve cage 24'. In addition, the pressure regulator cage 111 is provided with a relief port 135 to place the spring chamber 130 in flow communication with the supply/drain chamber 32.

The functional operation of this alternate unit injector embodiment shown in FIG. 7 and schematically in FIG. 8 is similar to that previously described with reference to the FIGS. 1 and 5 embodiment, except that maximum peak pressure relief in this embodiment is also controlled by the spring 131 biased pressure relief disc valve 133.

Preferably, the force of the spring 131 is preselected so that this secondary peak pressure relief valve 133 will open at the same pressure at which the associate control valve 68 is set to open. Thus using the above described example, if the control valve 68 is set to open at approximately 18,000 psi, the relief valve 133 would also be set to open at approximately 18,000 psi. It should also be realized that the central passage 134 flow area can be selected, as desired, relative to the pump capacity so that regardless of the flow capacity of the drain orifice passage, as defined by the control valve 68 and valve seat 80, sufficient pressure relief drain flow will occur so as to limit the maximum peak pressure to a preselected desired level.

Figure 9:
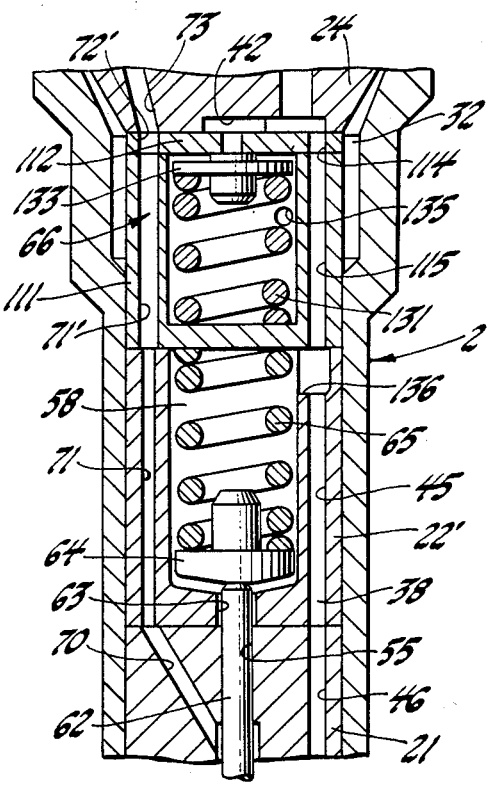

Referring now to FIG. 9, there is illustrated a portion of a unit fuel injector embodiment which is a modification of the embodiment shown in FIG. 1. In this FIG. 9 embodiment, the director cage 23 of the FIG. 1 unit injector has been replaced by the orifice plate 112 and the pressure regulator cage 111; spring 131; and, the pressure relief disc valve 133 assembly of the FIG. 6 structural embodiment. In addition, the valve spring cage 22', which is otherwise similar to the valve spring cage 22 previously described, is also provided with an upper radial slot 136 for flow communication from the passages 115 and 45 into the spring chamber The injection valve 51 valve opening pressure VOP and valve closing pressure VCP as a fixed pressure ratio to VOP, is in accord with the following equations with reference to the embodiments of FIGS. 1 and 5.

$$VOP = Pm = \frac{Ps\,(A_2 - A_3 - A_1) - Fs}{A_2 - A_1}$$

$$VCP = \frac{PS\,(A_2 - A_1) - Fs}{A_1}$$

wherein

Pm is the modulated pressure established in the servo control chamber 56 when the pilot control valve is open, and this modulated pressure, as previously described, is a function of the flow areas ratio of the throttle orifice and drain orifice:

$A_1$ is the cross-sectional area of the servo piston which is the same as the stem **51*b*** end of the injection nozzle;

$A_2$ is the cross-sectional area of the servo piston or stem portion **51*a***;

$A_3$ is the effective exposed area of the needle tip end of the injection valve 51;

Fs is the force of the valve return spring 65; and,

Ps is the system pressure.

In a particular unit injector application, the areas $A_1$, $A_2$ and $A_3$ were as follows:

$A_1 = 0.00636\ mm^2$ $A_2 = 0.02087\ mm^2$ $A_3 = 0.00716\ mm^2$

Accordingly the VOP and VCP in this application would be as follows:

$$VOP = Ps\,(0.00735) - Fs$$

$$VCP = Ps\,\frac{(0.01051) - Fs}{0.01451}$$

Since the system pressure (Ps) rate is a function of plunger 11 velocity (fuel displacement from the pump chamber 16), both the valve opening pressure (VOP) and the valve closing pressure (VCP) will increase as a direct function of engine speed.

The subject hydraulic force servo controlled electromagnetic unit fuel injector is operable to provide the following advantages:

Rate of injection shaping (Injection profile), that is, the quantity of fuel injected per degrees of injector drive cam rotation;

High injection termination rate;

Nozzle valve VOP variable with engine RPM;

Nozzle valve VCP above VOP as a fixed pressure ratio to VOP; and,

Programmable pilot injection control, that is, the injection characteristics of the subject unit injector can be customized, as desired, for a particular diesel engine to provide for maximum engine performance and emission control.

In addition, by having the control valve 68 operatively arranged so as to also operate as a pressure relief valve, and preferably having a secondary pressure relief valve incorporated into the electromagnetic unit fuel injector, all of such unit injectors used in a multi-cylinder engine application can be arranged to operate at a substantially uniform maximum peak pressure operating condition.

While the invention has been described with reference to the structures disclosed herein, it is not confined to the specific details set forth, since it is apparent that many modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. In an electromagnetic unit fuel injector of the type including a housing means having a pump cylinder means therein; an externally actuated plunger reciprocable in said cylinder means to define therewith a pump chamber open at one end for the discharge of fuel during a pump stroke and for fuel intake during a suction stroke of said plunger; an inlet passage means with a one-way valve therein in flow communication at one end with said pump chamber and connectable at its other end to a source of fuel at a suitable supply pressure; said housing means including a valve body having a spray outlet at one end thereof for the discharge of fuel; an injection valve means movable in said valve body to control flow through said spray outlet; a pressure modulated servo chamber in said housing means, a spring means and a servo piston means operatively connected to said injection valve means with said servo piston means being positioned so as to be acted on by the pressure of fuel in said pressure modulated servo chamber; a discharge passage means connecting said pump chamber to said spray outlet and to said pressure modulated servo chamber and having a throttle orifice of predetermined flow area controlling fuel flow into said pressure modulated servo chamber; a drain passage means in said housing means connectable at one end to a source of fuel at a suitable supply pressure said drain passage means including a drain chamber means and a pressure equalizing chamber means in axially spaced apart relationship to each other and in flow communication with each other with a valve stem stepped guide bore extending therebetween; and, a solenoid actuated control valve controlled orifice passage means for effecting flow communication between said pressure modulated servo chamber and said drain chamber, the improvement wherein said valve stem stepped guide bore is stepped next adjacent to said drain chamber wherein said control valve is in the form of an unbalanced pressure poppet valve having a head and a stem that is slidably in said valve stem guide bore and which normally biased to a closed position by a valve return spring of preselected force, said stepped bore being enlarged next adjacent said head whereby said control valve is also operative as a pressure relief valve to effect drainage of fuel at a predetermined maximum peak pressure from said pressure modulated servo chamber to said drain chamber.

2. In an electromagnetic unit fuel injector of the type including a housing means having a pump cylinder means therein; an externally actuated plunger reciprocable in said cylinder means to define therewith a pump chamber; said housing means including a valve body having a spray outlet at one end thereof for the discharge of fuel; an injection valve movable in said valve body to control flow through said spray outlet; an inlet passage means in flow communication with said pump chamber and being connectable at its other end to a source of fuel; a pressure modulated servo chamber means in said housing means, a spring means and a servo piston means operatively connected to said injection valve with said servo piston means being positioned so as to be acted on by the pressure of fuel in said servo chamber; a discharge passage means in said housing means connecting said pump chamber to said spray outlet and to said servo chamber and having a throttle orifice controlling fuel flow to said servo chamber, said housing means further including a drain passage means in flow communication at one end with said servo chamber and at its opposite end with a source of fuel at a predetermined pressure, said drain passage means including drain chamber means and a pressure equalizing chamber means in axially spaced apart relationship to each other with a guide bore extending therebetween and with a conical valve seat encircling said guide bore at the drain chamber end thereof; a pressure sensitive control valve operatively positioned in said housing means, said control valve having a stem slidably received in said guide bore and a head loosely received in said drain chamber with a valve seating surface for movement relative to said valve seat and defining therewith when unseated therefrom a drain orifice, said stem including a reduced diameter stem portion next adjacent to said valve seating surface of said head whereby to define with said guide bore an annulus chamber as part of said drain passage means; a pull type solenoid means operatively supported in said housing means, said solenoid means including an armature means operatively associated with said control valve; a valve return spring operatively associated with said control valve to normally bias said valve seating surface of said head thereof into seating engagement with said valve seat; and, a fuel passage means connectable at one end to a source of fuel at a suitable supply pressure and at its other end being in operative flow communication with said pump chamber; the improvement wherein said control valve is in the form of a poppet valve and wherein said stepped bore includes an enlarged internal diameter portion next adjacent to said valve seat whereby the pressure of fuel in said annulus cavity can act against said head in a valve opening direction and wherein the force of said valve return spring is preselected so that said control valve is also operative as a pressure relief valve.

3. In an electromagnetic unit fuel injector in accordance with claim 1 or claim 2, wherein said housing means further includes a secondary pressure relief passage means with a pressure relief valve means therein in flow communication at one end with said discharge passage means and at its other end with said drain passage means downstream of said drain chamber means in terms of the direction of flow through said drain passage means from said servo chamber, said pressure relief valve means being operative at substantially the same predetermined maximum peak pressure as said control valve.

* * * * *